United States Patent [19]

Borges

[11] Patent Number: 4,642,963

[45] Date of Patent: Feb. 17, 1987

[54] PREFABRICATED BUILDING PANELS AND SYSTEM

[76] Inventor: Anthony A. Borges, 18601 South Main St., Gardena, Calif. 90248

[21] Appl. No.: 623,155

[22] Filed: Jun. 21, 1984

[51] Int. Cl.[4] ..... E04B 2/62; E04C 1/10

[52] U.S. Cl. ..... 52/584; 52/407

[58] Field of Search ..... 52/127.5, 127.7, 127.11, 52/407, 582, 584

[56] References Cited

U.S. PATENT DOCUMENTS

| | | | |
|---|---|---|---|
| 1,535,504 | 4/1925 | Stephens | 52/407 |
| 3,439,465 | 4/1969 | Du Pre | 52/582 |
| 3,491,820 | 1/1970 | Ostling | 52/582 |
| 4,004,391 | 1/1977 | Keeton | 52/584 |

FOREIGN PATENT DOCUMENTS

| | | | |
|---|---|---|---|
| 1409713 | 10/1975 | United Kingdom | 52/127.7 |

*Primary Examiner*—Rodney H. Bonck
*Assistant Examiner*—John Malcolm White
*Attorney, Agent, or Firm*—Quaintance, Murphy & Presta

[57] ABSTRACT

A prefabricated building system comprising wall panels having interior and exterior surfaces with insulation positioned therebetween. The interior and exterior surfaces may be of any suitable finish and appearance, depending on the building to be constructed. Each of the panels is provided with releasable locking devices on the side and/or end edges thereof which are constructed to enable the panels to be locked to adjacent panels, sills or the like after the panels have been positioned in their desired location in the building. The releasable locking devices are actuated from the exterior of the panels so that they can be conveniently locked together or unlocked, if desired, after they have been positioned in their desired locations. Each panel comprises a frame formed of elongated channel members for strength and load bearing capability. The channel members are provided with spaced clip members which serve to support the insulation between the interior and exterior surfaces of the panel. The clip members also serve to movably support the releasable locking devices. A new and improved locking and support structure is provided for supporting prefabricated roof panels on the wall panels.

9 Claims, 14 Drawing Figures

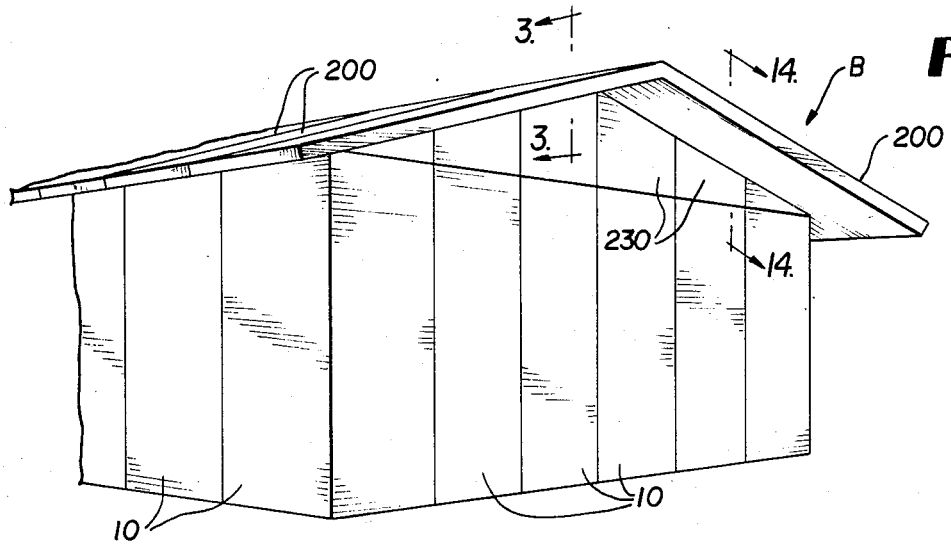
FIG. 1
FIG. 2
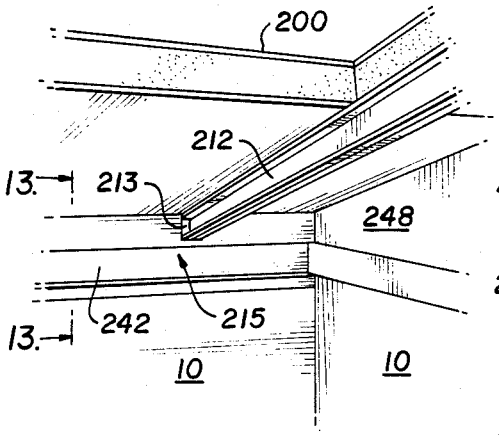
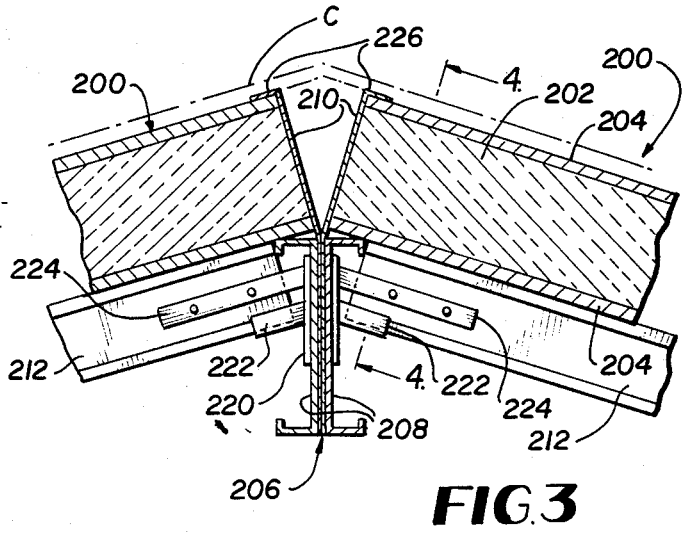
FIG. 3
FIG. 4
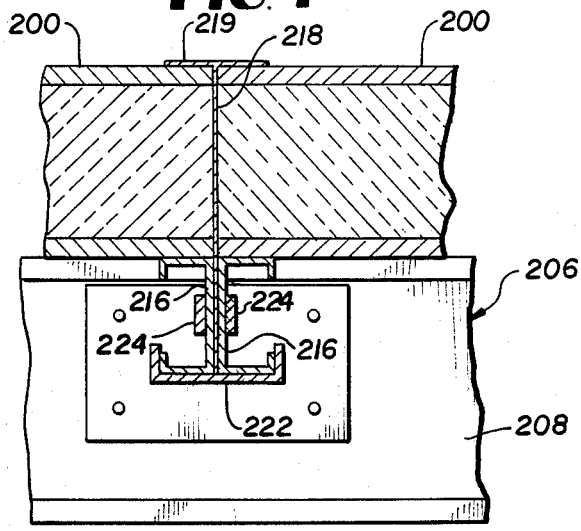
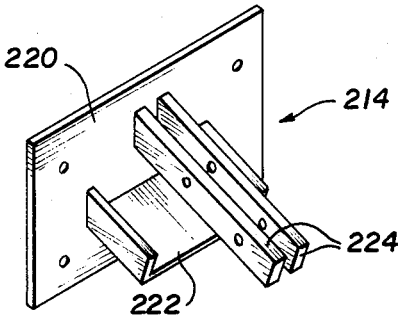
FIG. 5

FIG. 6
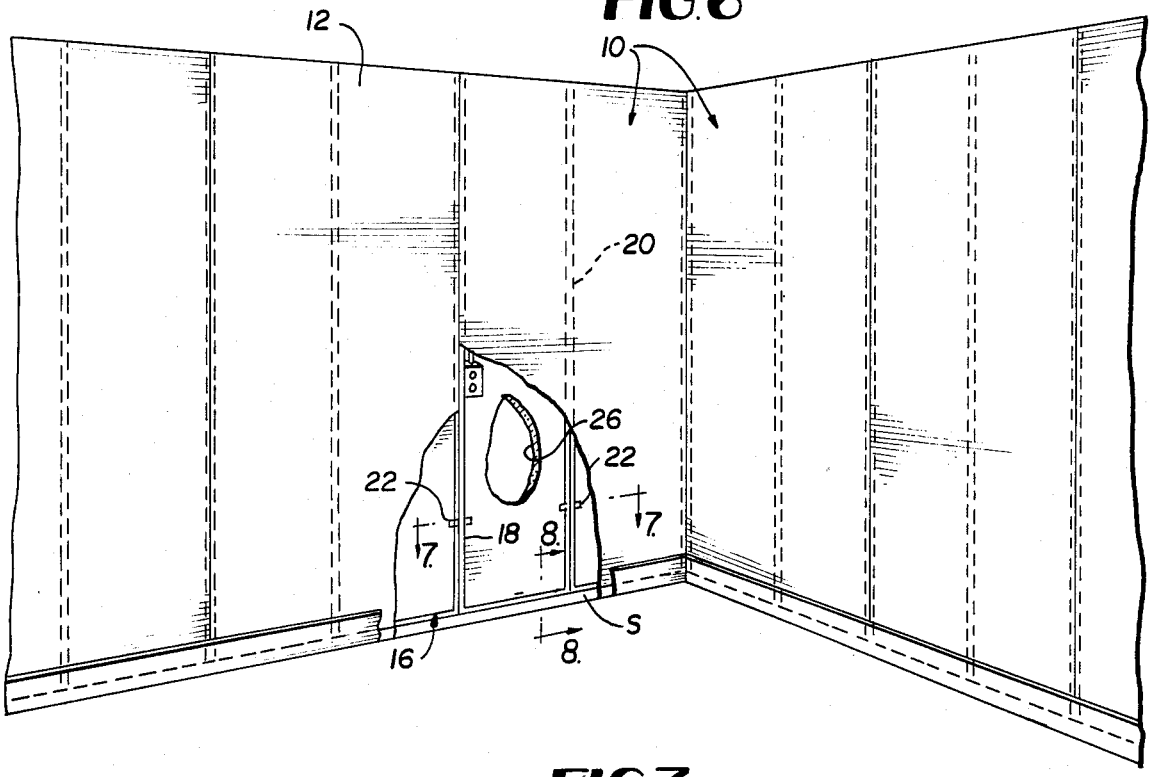
FIG. 7
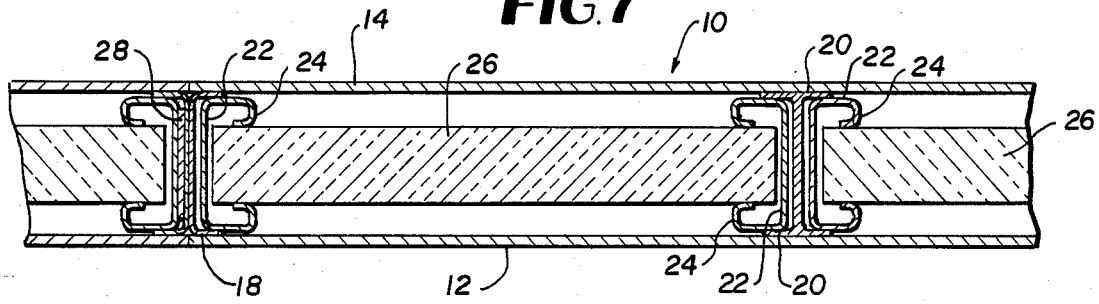
FIG. 8
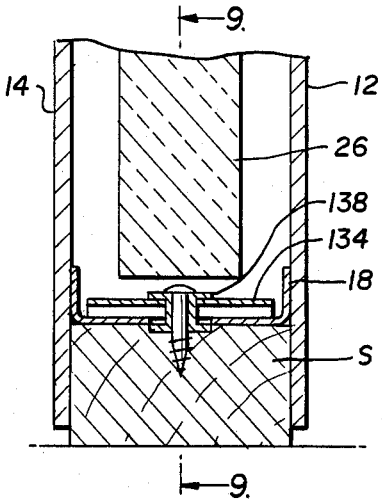
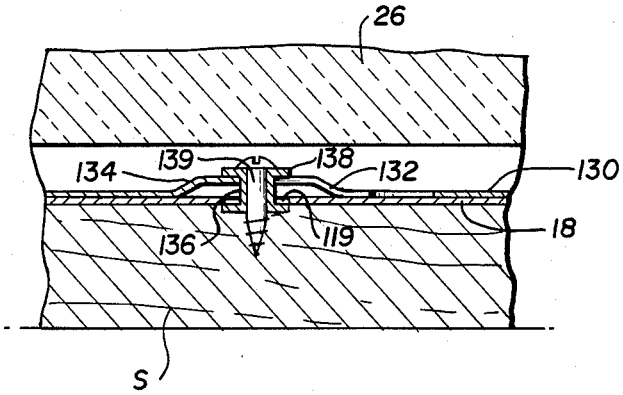
FIG. 9

FIG. 10
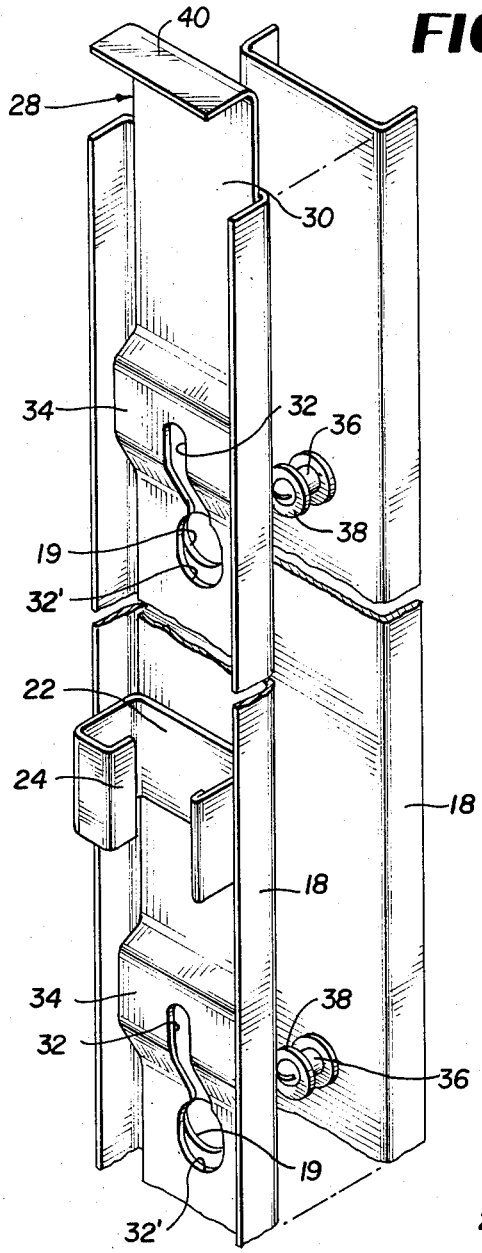
FIG. 11
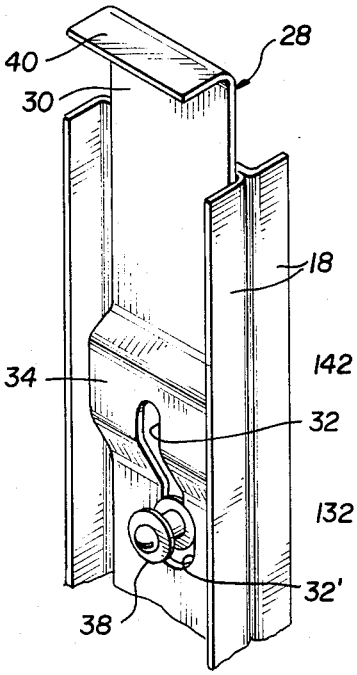
FIG. 12
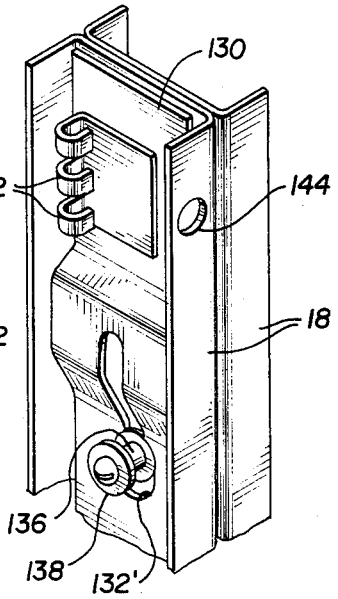
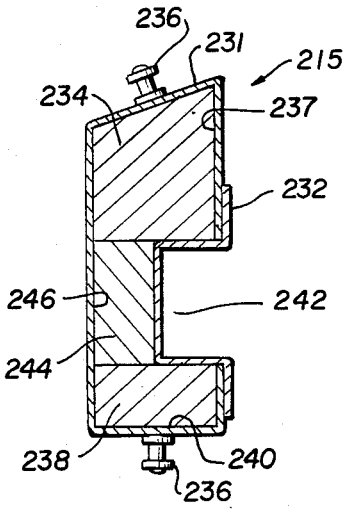
FIG. 13
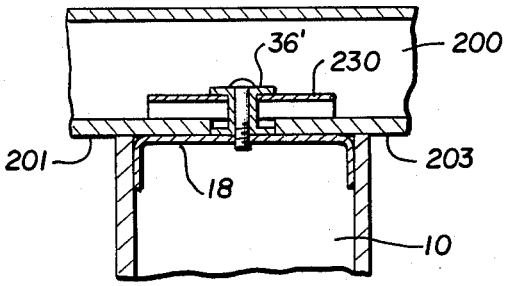
FIG. 14

PREFABRICATED BUILDING PANELS AND SYSTEM

BACKGROUND OF THE INVENTION

The present invention relates to a prefabricated building system and, more particularly, to new and improved prefabricated panels for such a system which can be locked together after they are positioned in a desired location in the building.

At the present time, most homes and other buildings are constructed at the site with little, if any, prefabrication. Accordingly, homes and other buildings are expensive because of high material and labor costs and a long period of construction.

While many systems for prefabricating homes and other buildings have been proposed and/or tried to a limited extent, these systems have not met with wide acceptance because they have been subject to one or more of the following disadvantages:

1. The cost savings have been minimal;
2. They have been difficult to assemble on the site;
3. The prefabricated sections have been heavy and/or bulky and thus difficult to ship and handle;
4. They have not met the requirements of local building codes;
5. They have been unattractive in appearance; and/or
6. They have been weak from a structural viewpoint.

The prefabricated building system and panels of the present invention are not subject to any of the above disadvantages, and possess many advantages over previously and presently used prefabrication systems.

SUMMARY OF THE INVENTION

The prefabricated building system of the present invention comprises a plurality of wall or building panels having finished interior and/or exterior surfaces. Between the interior and exterior surfaces, each panel is provided with appropriate insulation or other required elements such as wiring, plumbing or the like. Also, selected panels may be provided with door openings, windows or the like, depending on the building plan.

Preferably, the wall panels are formed in an appropriate, uniform size, such as 4 feet by 8 feet, and each panel comprises an outer frame formed of one or more channel members of metal or the like. For additional strength and load-bearing capability, each panel preferably comprises a channel or stud member extending through the mid-portion from the upper surface to the lower surface thereof.

A plurality of clip members are secured to the channel and stud members and are provided with flexible and resilient fingers for engaging and holding in place one or more insulating members within the panel in a desired position relative to the exterior and interior surfaces thereof. Preferably, the clip members are spaced from the channel members so as to slidably receive therebetween elongated locking members that are adapted to operatively engage locking pins or the like on an adjacent panel for the purpose of locking the panels together after they have been properly positioned in the building to be constructed. The panels are constructed such that the locking members are accessible from the exterior of each panel after the panels have been positioned adjacent to each other in their desired positions in the building. Accordingly, the panels can be conveniently locked together or released, if desired, after they have been placed in the proper position in the building.

With the prefabricated building system of the present invention, prefabricated panels of the same or similar type as the wall panels can be mounted on or secured to the wall panels to form a ceiling or roof. A new and improved system for supporting the roof panels and roof beams and tying them together is a part of the present invention. This system is described in further detail hereinafter.

BRIEF DESCRIPTION OF THE DRAWINGS

FIG. 1 is a perspective view of a portion of the exterior of a building constructed in accordance with the prefabricated building system and panels of the present invention;

FIG. 2 is an enlarged perspective view, with parts broken away, of a portion of the roof of the prefabricated building shown in FIG. 1;

FIG. 3 is an enlarged sectional view taken substantially along line 3—3 of FIG. 1;

FIG. 4 is an enlarged sectional view taken substantially along line 4—4 in FIG. 3;

FIG. 5 is a perspective view of a support bracket used in the roof construction shown in FIGS. 3 and 4;

FIG. 6 is a perspective view, with parts broken away, of a portion of the interior of the building shown in FIG. 1, with the prefabricated wall panels in position and releasably locked together in accordance with the principles of the present invention;

FIG. 7 is an enlarged sectional view taken substantially along line 7—7 in FIG. 6;

FIG. 8 is an enlarged sectional view taken substantially along line 8—8 of FIG. 6;

FIG. 9 is a sectional view taken substantially along line 9—9 in FIG. 8;

FIG. 10 is a side elevational view of one of the wall panels shown in FIG. 6.

FIG. 11 is an enlarged perspective view of a portion of the channel member, locking member and clip member of a panel constructed in accordance with the principles of the present invention;

FIG. 12 is a modified embodiment of the locking member shown in FIG. 11;

FIG. 13 is an enlarged sectional view taken substantially along line 13—13 in FIG. 2; and FIG. 14 is an enlarged sectional view taken substantially along line 14—14 in FIG. 1.

DESCRIPTION OF THE PREFERRED EMBODIMENTS

Referring to FIGS. 1, 6 and 7, a building B, such as a home or other structure, is formed of prefabricated panels 10 constructed and locked in position in accordance with the principles of the present invention. Preferably, the panels 10 are of uniform size, such as 4 feet by 8 feet and are provided with finished or partially finished interior and exterior surfaces, 12 and 14, respectively. As an illustrative example, the interior surface 12 may be formed of dry wall, panelling or the like, and the exterior surface 14 may be formed of exterior plywood, a stucco base, or any other desired exterior finish.

As shown in FIGS. 6 and 7, each of the panels 10 comprises an outer support frame 16 formed of generally U-shaped channel members 18 constructed of sheet metal or any other suitable, strong, lightweight material. The channel members 18 extend around the periphery of each panel and have secured thereto in any suitable manner the desired interior and exterior surfaces, 12 and 14. For additional strength, each panel preferably is provided with an additional channel member or stud 20 of any suitable construction extending lengthwise through the mid-portion thereof from the upper channel member to the lower channel member.

As is specifically illustrated in FIGS. 6, 7 and 11, a plurality of generally U-shaped clip members 22 having inwardly extending, flexible and resilient fingers 24 are secured to the channel members 18 in a desired spaced relation along the length thereof. The clip members 22 preferably serve to support sections of insulation 26 of any suitable type between and in a desired position relative to the interior and exterior surfaces of each panel. The peripheral portions of each insulation section 26 are frictionally engaged by the flexible and resilient fingers 24 of the clip members 22. By spacing the insulation sections from the interior and/or exterior surfaces of each panel, air pockets are formed within the panel which provide additional insulating value and also room for utility apparatus such as electrical wiring, plumbing or the like. The clip members 22 may have a pair of resilient fingers 24 (FIG. 7) or one resilient finger 24 (FIG. 11) depending on the desired position of the insulation section 24 relative to interior and exterior surfaces 12 and 14 of each panel 10. Within the scope of the present invention, electrical wiring and/or plumbing may be substituted in whole or in part for or added to the insulation sections 26. Also, certain panels 10 may be provided with windows, window openings, door openings or the like.

A significant feature of the present invention is the provision of locking devices on the panels 10 which enable them to be locked to adjacent panels or to sills or the like after they have been positioned in a desired location in the building being constructed. As a preferred embodiment, each panel 10 is provided with an elongated locking member 28 on one side thereof that is mounted for longitudinal slidable movement between the clip members 22 and the adjacent channel members 18. It will be readily apparent, therefore, that the clip members 22 serve to support the insulation sections 26 within each panel and also serve to slidably support the locking members 28 on each panel.

Each of the elongated locking members 28 preferably is formed of a strip 30 of sheet metal or the like that extends through substantially the entire length of the panel 10 and is provided with a plurality of spaced, longitudinally extending locking slots 32. The locking strip 30 is provided with spaced, raised portions 34 that extend partially through one end of each locking slot 32. The other end of each locking slot 32 is provided with an enlarged portion 32' for a purpose to be more fully described hereinafter.

On the side of each panel 10 opposite to the side on which the locking strip 30 is mounted, a plurality of laterally outwardly extending locking pins 36 are secured to the channel member 18 in any suitable manner, such as by bolts, rivets or the like. The locking pins 36 are spaced longitudinally a distance corresponding to the distances between the slots 32 of the locking strips 30, and each locking pin is provided with an enlarged head portion 38 that is adapted to be received within the enlarged portion 32' of the adjacent or corresponding locking slot 32. The portion of the channel member 18 adjacent the locking strip 30 is provided with a plurality of apertures 19 that are aligned with the locking pins 36 and are of a size sufficient to receive the enlarged head portions 38 therethrough.

Through the use of the locking strips 30 and locking pins 36, wall panels 10 can be positioned in a desired location adjacent to each other and can be conveniently releasably locked together after they have been so positioned. This is accomplished by the insertion of the locking pins 36 of one wall panel through the channel member apertures 19 and the enlarged portions 32' of the locking slots 32 of the locking strip 30 mounted on the adjacent wall panel. Thereafter, a transverse portion 40 on the upper end of the locking strip 30 can be gripped to move the locking strip 30 downwardly to position the upper narrow ends of the locking slots 32 around the locking pins 36 and to frictionally engage the raised portions 34 on the locking strip 30 with the enlarged head portions 38 of the locking pins. The adjacent wall panels are now releasably locked together because of the engagement of the locking strip 30 with the enlarged head portions 38 of the locking pins. In this position, the upper transverse end 40 of the locking strip 30 is substantially flush with the upper adjacent surface of the panel on which it is mounted. If it is desired to separate the panels, the locking strip 30 can be moved upwardly by engagement of its upper transverse portion 40 to release the locking pins and allow the panels 10 to be separated.

Referring to FIGS. 6, 8 and 9, a similar locking arrangement is illustrated for securing the wall panels 10 to a sill S or the like which is provided with a plurality of longitudinally spaced locking pins 136 having enlarged head portions 138 that are secured thereto in any suitable manner, such as by screws 139. The locking pins 136 preferably are substantially the same as the locking pins 38 provided on the side surfaces of the panels 10. The bottom surface or channel member 18 of each panel 10 comprises a plurality of apertures 119 therethrough that are disposed in alignment with the locking pins 136 on the sill S and are of a size sufficiently large to receive the enlarged head portions 138 of the locking pins 136 therethrough.

A locking strip 130 is slidably mounted between the bottom channel member 18 and the clip members 22 secured thereto in a manner substantially the same as that of the locking strip 30 mounted on the sides of the wall panels 10. Like the locking strip 30 illustrated in FIG. 11, the locking strip 130 is provided with a plurality of raised portions 134 and locking slots 132 with enlarged end portions 132' for receiving the enlarged head portions 138 of the locking pins 136. To facilitate the positioning of the panels 10, the enlarged portions 32' on the side locking strips 30 preferably are elongated, while the enlarged portions 132' on the bottom locking strips 130 are generally circular in shape.

In practice, the wall panels 10 are positioned on the sill S with the locking pins 136 extending through the holes 19 in the bottom channel member 18 and through the enlarged end portions 132' of the locking slots 132. Thereafter, lateral movement of the elongated locking strip 130 serves to move the raised portions 134 thereof into frictional engagement with the enlarged head portions 138 of the locking pins 36 when the locking pins are at the narrow ends of the locking slots 132. As shown in FIG. 12, the locking strip 130 may be moved into locking engagement with the locking pins 136 after the panels 10 have been positioned on the sill S by engaging a tool (not shown), such as a screwdriver, with teeth or raised portions 142 or the like that are formed on or secured to the locking strip 130. The teeth 142 are engageable by the tool through an aperture 144 provided in a side portion of the channel member 18 opposite to the teeth 142.

FIGS. 2 through 5 illustrate a new and improved system for mounting a plurality of prefabricated roof panels 200 on the wall panels 10 after the wall panels have been properly positioned and locked in place in the building B. The prefabricated roof panels 200 may be of any desired size or construction, and preferably comprise an inner insulating layer 202 surrounded by outer layers 204 formed of any suitable materials.

A ridge beam 206, preferably formed of generally U-shaped channel members 208, extends across and is supported in any suitable manner (not shown) on the top of the assembled wall panels 10. The channel members 208 preferably are secured in back-to-back relation, with a pair of flexible strips 210 secured therebetween in any suitable manner and extending upwardly therefrom for a purpose to be more fully described hereinafter.

A plurality of rafters 212 extend generally transversely to the beam 206 and may be supported at their outer or lower ends in recesses 213 in a loam beam 215 mounted on the wall panels 10 and secured thereto in any suitable manner, and at their inner or upper ends on support brackets 214 secured to the beam 206. Alternatively, the rafters may be supported at their lower ends on support brackets like the brackets 214 secured to the load beam 215. The rafters 212 may be of any suitable construction and preferably are formed of a pair of generally U-shaped channel members 216 that are secured together in back-to-back relation with a T-strip 218 secured thereto in any suitable manner and extending upwardly therefrom.

Each bracket 214 comprises a plate 220 that is secured in any suitable manner to the beam 206. Secured to the plate 220 and extending downwardly and outwardly at a predetermined angle therefrom are a generally U-shaped base plate 222 and a pair of substantially parallel arms 224 that are disposed above the base plate 222. As shown in FIG. 3, the inner or upper ends of the roof truss members 212 rest on the base plates 222 and extend between the arms 224 and are secured thereto in any suitable manner, such as by bolts or rivets.

After the ridge beam 206 and rafters 212 are positioned on the assembled wall panels 10 and secured together by the brackets 214, the roof panels 200 are positioned on the rafters 212 with the upper transverse end 219 of each strip 218 of each rafter extending over the adjacent edges of the roof panels on each rafter, in the manner shown in FIG. 4. After the roof panels 200 are so positioned, the transverse ends 219 of the strips 218 are secured in any suitable manner to the adjacent roof panels 200, and the upper ends of the flexible strips 210 of the ridge beam 206 are bent over the upper or inner ends of the roof panels at 226 and secured thereto in any suitable manner, as shown in FIG. 3. A cover or flashing C (shown in broken lines in FIG. 3) is then placed over the upper ends of the roof panels 200 to cover the space between the strips 210 secured to the roof panels.

As shown in FIG. 13, the load beam 215 preferably is formed of a pair of elongated channel members 231 and 232 formed of metal plates or the like and secured together in any suitable manner. A reinforcing member such as a 4 inch by 4 inch wood beam 234 is positioned in the upper interior channel 237. Similarly, a 2 inch by 4 inch wood beam 238 is positioned in the lower channel 240. The intermediate elongated recess 242 is provided to accommodate electrical wiring (not shown) or the like extending between the wall panels 10 and the roof panels 200. If desired, a second 2 inch by 4 inch wood beam 244 could be positioned in the middle channel 246. The channel member 231 may be provided with locking pins 236 on its upper and lower surfaces for securing the load beam 215 to the adjacent wall panels 10 and roof panels 200 by means of movable locking strips therein that are the same as or similar to the strips 30 and 130 shown in FIGS. 11 and 12.

In the assembly of the roof panels 200 to the wall panels 10, the roof panels may be secured to the wall panels in any suitable manner; the wall panels may be formed with inclined upper ends to accommodate the slant of the roof panels; or insert panels 248 (FIG. 1) of any suitable construction may be mounted on the upper ends of the wall panels 10 and secured thereto and to the roof panels 200 in any suitable manner.

Referring to the illustrative example shown in FIG. 14, each corner roof panel 200 at an overhang may be provided with a movable locking strip 230 like the locking strips 30 on the wall panels 10. The adjacent wall panels 10 have spaced locking pins 36' on the upper surfaces thereof which are adapted to be releasably engaged by the locking strip 230 to secure the roof panel 200 to the wall panels 10. The locking pins 36' are longer than the locking pins 36 on the sides of the wall panels for the reason that the locking strip 230 is recessed within the roof panel 200. The lower surfaces 201 and 203 on the roof panel are laterally spaced apart a distance sufficient to allow the locking pins 36' to pass therebetween. By way of example, the interior lower surface 201 may be dry wall and the exterior lower surface 203 may be plywood.

What is claimed is:

1. A prefabricated building panel, comprising:

peripheral frame means;

an interior surface having a predetermined finish secured to one side of said frame means;

an exterior surface having a predetermined finish secured to the other side of said frame means;

male locking means on one edge portion of said frame means;

an aperture on the opposite edge portion of said frame means, said aperture being of a size and shape to allow male locking means on an adjacent panel to extend therethrough;

female locking means slidably mounted on said opposite edge portion of said frame means, said female locking means being movable between an unlocked position wherein it is adapted to receive a corresponding male locking means on an adjacent building panel that is positioned through said aperture, and a locked position wherein it engages said corresponding male locking means to connect the building panel to said adjacent building panel;

actuating means on said female locking means for enabling it to be moved to said locked and unlocked positions from the exterior of the buiding panel;

an intermediate section mounted on said frame means between said interior and exterior surfaces; and clip means mounted on said frame means for supporting said intermediate section and for slidably supporting said female locking means on said frame means, said clip means being spaced from said frame means to provide an elongated space in which said female locking means is slidably movable, said clip means comprising a plurality of generally U-shaped clips having flexible and resilient fingers for engaging said intermediate section, and having a generally flat section spaced from said frame means and substantially parallel thereto for slidable engagement with said female locking means.

2. The building panel of claim 1 wherein said frame means comprises an elongated generally U-shaped channel member.

3. The building panel of claim 1 wherein said intermediate section is formed of insulation.

4. The building panel of claim 1 wherein said frame means comprises second female locking means mounted on the bottom edge portion thereof and adapted to receive a corresponding male locking means on an adjacent sill.

5. The buiding panel of claim 1 wherein said frame means is generally rectangular in shape, and said male and female locking means are mounted on opposite side edge portions of-said frame means.

6. The buiding panel of claim 1 wherein said male locking means is a locking pin with an enlarged head portion, and said female locking means is a flexible and resilient strip with an elongated slot therein, said slot having an enlarged opening at one end thereof for receiving the head portion of said locking pin when said female locking means is in said unlocked position, said strip having a raised portion near the other end of said slot for frictionally engaging said head portion when said female locking means is in said locked position and said locking pin is adjacent said other end of said slot.

7. The building panel of claim 6 wherein said actuating means is a bent portion on one end of said strip that extends outwardly of said frame means.

8. The building panel of claim 6 wherein said actuating means comprises tooth means on said strip that is engageable from the exterior of said frame means.

9. The building panel of claim 6 wherein said one edge portion of said frame means comprises a plurality of locking pins disposed in longitudinally spaced relation, and said strip is elongated and provided with a plurality of slots and raised portions that are longitudinally spaced in corresponding relation to the spacing of said locking pins.

* * * * *